US005120912A

United States Patent [19]

Sharp

[11] Patent Number: 5,120,912

[45] Date of Patent: Jun. 9, 1992

[54] MEMBRANE SWITCH WITH SERIES RESISTOR

[75] Inventor: Larry L. Sharp, Rolling Meadows, Ill.

[73] Assignee: Illinois Tool Works Inc., Glenview, Ill.

[21] Appl. No.: 555,197

[22] Filed: Jul. 20, 1990

[51] Int. Cl.[5] ..... H01H 15/02

[52] U.S. Cl. ..... 200/16 R; 200/512

[58] Field of Search ..... 200/5 R, 5 A, 16 R, 200/16 C, 160, 265-267, 512-517; 338/99, 154, 172, 173, 176, 198, 200, 179

[56] References Cited

U.S. PATENT DOCUMENTS

| | | | |
|---|---|---|---|
| 4,007,364 | 2/1977 | Ojima et al. | 200/5 A X |
| 4,322,588 | 3/1982 | Chumley et al. | 200/5 A |
| 4,415,781 | 11/1983 | Frame et al. | 200/5 A X |
| 4,438,301 | 3/1984 | Van Zeeland | 200/16 D X |
| 4,440,990 | 4/1984 | Nozaki | 200/5 A |
| 4,506,118 | 3/1985 | Mollman | 200/1 R |
| 4,651,123 | 3/1987 | Zepp | 338/154 X |
| 4,731,509 | 3/1988 | Miyamoto | 200/16 R |
| 4,744,645 | 5/1988 | Sharp | 350/631 |

*Primary Examiner*—J. R. Scott
*Attorney, Agent, or Firm*—Schwartz & Weinrieb

[57] ABSTRACT

A membrane switch is formed of an upper layer of electrically insulating material, a lower layer of electrically insulating material, and an intermediate layer of electrically insulating material interposed between the upper layer of electrically insulating material and the lower layer of electrically insulating material. A first electrically conductive layer is printed upon the lower surface of the upper layer of electrically insulating material. A second electrically conductive layer is printed upon the upper surface of the lower layer of electrically insulating material. A resistive component is printed upon an end portion of the second electrically conductive layer. The intermediate layer of electrically insulating material is provided with an opening so as to enable the first electrically conducting layer to initially engage with the resistive component when the upper layer of electrically insulating material is moved downwardly by means of an actuating member so as to produce an electrical connection between first and second switch terminals of the first and second electrically conductive layers which exhibits low current flow corresponding to a first slidable position of the actuating member, while when the actuating member is slidably moved further in the same direction, direct connection between the first and second electrically conductive layers, without the resistive component being interposed therebetween in a series manner, is established so as to exhibit higher current flow between the first and second electrically conductive layers and within the electrical circuit.

18 Claims, 2 Drawing Sheets

MEMBRANE SWITCH WITH SERIES RESISTOR

FIELD OF THE INVENTION

This invention relates generally to electrical switches and more particularly, it relates to a membrane switch which includes a series resistor so as to provide an initially reduced amount of current flow.

BACKGROUND OF THE INVENTION

It is generally well known that electrical switches have been used withn a current flow path for coupling a power source to a load, such as, for example, a lamp for illuminating a certain area. When the load is a lamp, it has been encountered that many times it is desired to initially turn the lamp on with a relatively low light intensity and then to increase the illumination so as to provide full light intensity after a predetermined period of time.

Heretofore, an electrical switch of the type noted above has been regarded as being complex in nature and somewhat difficult to manufacture. Accordingly, there has arisen a need for an electrical switch of the type noted which is relatively simple in its construction and is easy to assemble and manufacture.

OBJECTS OF THE INVENTION

Accordingly, it is a general object of the present invention to provide an improved membrane switch which is relatively simple and economical to manufacture and assemble.

It is an object of the present invention to provide an improved membrane switch which includes a series resistor so as to provide an initially reduced amount of current flow.

It is another object of the present invention to provide an improved membrane switch which is initially turned on with a series resistor within the currert flow path, thereby avoiding any problems of arcing.

SUMMARY OF THE INVENTION

In accordance with these aims and objectives, the present invention is concerned with the provision of a membrane switch which includes an upper layer of electrically insulating material, a lower layer of electrical insulating material, and an intermediate layer of electrical insulating material being interposed between the upper layer of electrical insulating material and the lower layer of electrical insulating material. A first electrically conductive layer is printed upon the lower surface of the upper layer of electrical insulating material. The first electrical conductive layer terminates at one end with a first switch terminal. A second electrically conductive layer is printed upon the upper surface of the lower layer of electrical insulating material. The second electrically conductive layer terminates at one end with a second switch terminal. The second electrically conductive layer has a resistive component printed upon its end portion opposite the second switch terminal.

The intermediate layer of electrical insulating material has an opening formed therein so as to enable the first electrically conductive layer disposed upon the upper layer of electrical insulating material to, be movable therein so as to initially engage with the resistive component when the upper layer of electrical insulating material is moved downwardly by means of an actuating member so as to produce an electrical connection between the first and second switch terminals and the first and second electrical conductive layers associated therewith. The actuating member is slidably moved so as to cause subsequent engagement of the first electrically conductive layer disposed upon the upper layer of electrically insulating material with the second electrically conductive layer on the lower layer of electrically insulating material.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, and wherein.

DESCRIPTION OF THE PREFERRED EMBODIMENT

Figure 1:
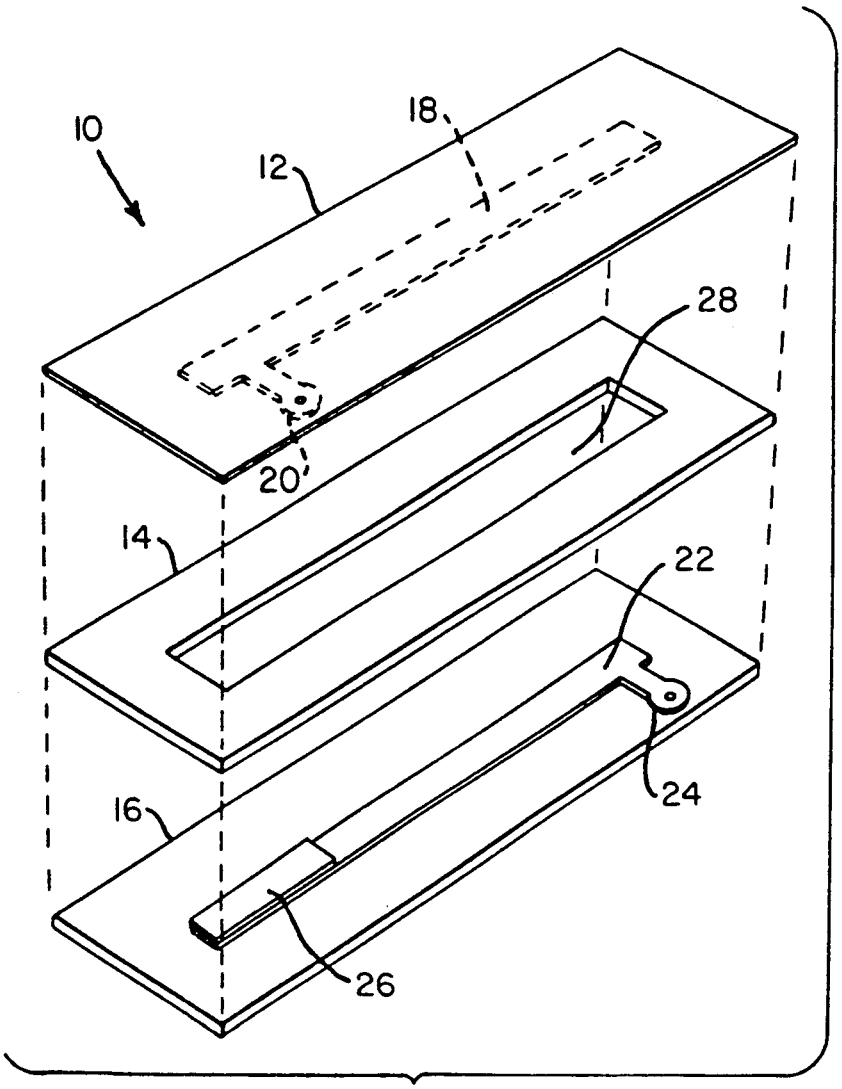
FIG. 1 is an exploded, perspective view of a membrane switch, constructed in accordance with the principles of the present invention.

Referring now in detail to the drawings, there is shown a membrane switch 10 constructed in accordance with the principles of the present invention. The membrane switch is preferably comprised of an upper layer 12 of an electrically insulating material, an intermediate or spacer layer 14 of an electrically insulating material, and a lower layer 16 of an electrically insulating material. Each of the layers 12, 14 and 16 is preferably formed of Mylar.

The lower surface of the upper layer 12 is provided with an electrically conductive layer 18 such as, for example, a metallic film terminating at one end in a first switch terminal 20. The conductive layer 18 and the upper layer 12 form what is sometimes referred to as polymer thick film (PTF) circuitry. Accordingly, the conductive layer 18 is screen-printed upon the lower surface of the upper layer 12 in a silver particle-laden polymeric ink. The upper surface of the lcwer layer 16 is provided with an electrically conductive layer 22 such as, for example, a metallic film terminating at one end in a second switch terminal 24. The conductive layer 22 and the lower layer 16 also exemplify polymer thick film circuitry. Thus, the conductive layer 22 is also screen-printed on the upper surface of the lower layer 16 in a silver particle-laden polymeric ink. Further, upon the left-end portion of the electrically conductive layer 22 the same is overlaid with a resistive component or pad 26 which is screen-printed in carbon particle-laden polymeric ink.

Figure 2:
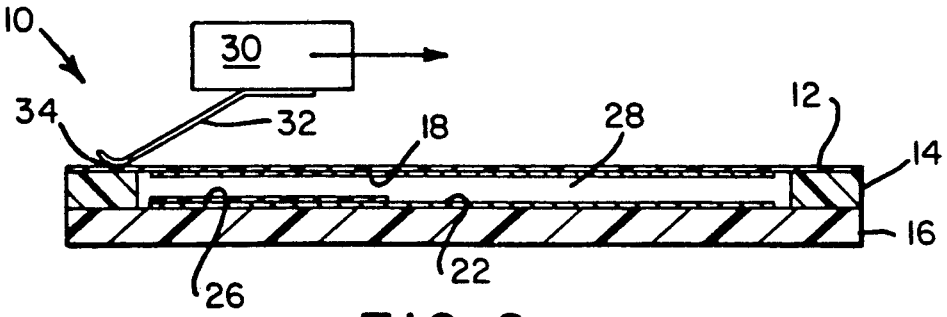
FIG. 2 is a cross-sectional view of the membrane switch of FIG. 1, illustrating its "OFF-position"
Figure 5:
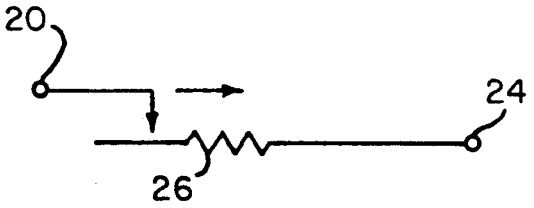
FIGS. 5–7 are schematic diagrams corresponding to the respective positions of the switch and the actuating member shown in FIGS. 2–4.

The intermediate layer 14 is provided with an opening 28 which separates the first and second conductive layers 18 and 22 when the switch actuator formed of a mechanical slide member 30 and a spring member 32 is disposed at its rest or OPEN or OFF position, as is illustrated in FIGS. 2 and 5. As will be noted, the spring member 32 includes a downwardly extending finger 34 which engages the first electrically conductive layer 18 with the spacer layer 14 in the "OPEN" or OFF-position.

Figure 3:
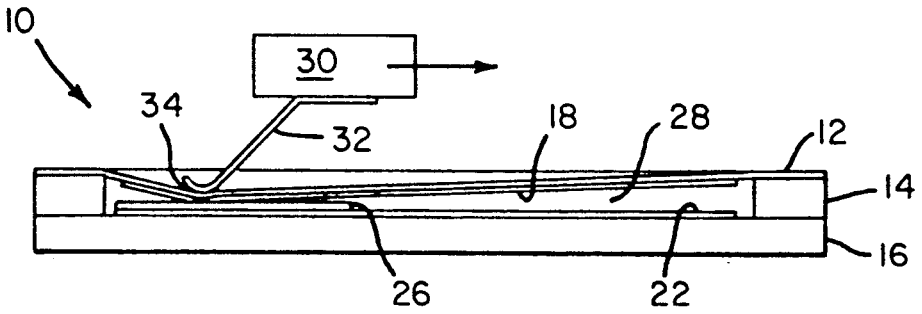
FIG. 3 is a cross-sectional view of the membrane switch of FIG. 1, illustrating its initial low-current flow "ON position"
Figure 6:
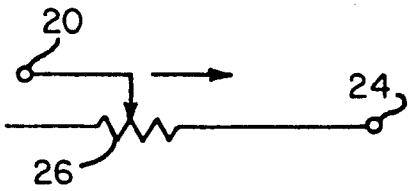

As the slide member 30 is moved in the direction of the arrow toward the right and to the initial "ON-position" of FIGS. 3 and 6, the upper layer 12 is flexed downwardly by means of the finger 34 of the spring member 32 connected to the slide member 30. As a result, the first conductive layer 18 is caused to move downwardly through the opening 28 defined within the intermediate layer 14 and into engagement with the resistive component or pad 26. Due to the resistive carbon layer 26 interposed between the first and second conductive silver layers 18 and 22, a series resistance is provided within the current flow path between the electrical connection of the first and second switch terminals 20 and 24. Therefore, an initially reduced current flow passes to a load connectable to the second switch terminal 24 when a power source is connected to the first switch terminal 20. This feature also serves to eliminate any problems with arcing that could occur when the switch is initially turned ON.

Figure 4:
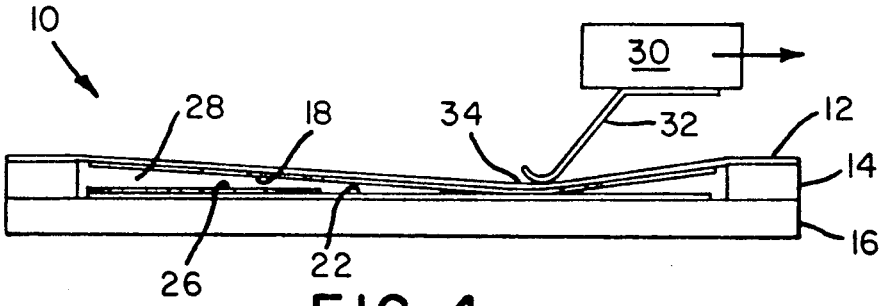
FIG. 4 is a cross-sectional view of the membrane switch of FIG. 1, illustrating its full "low-current flow ON"
Figure 7:
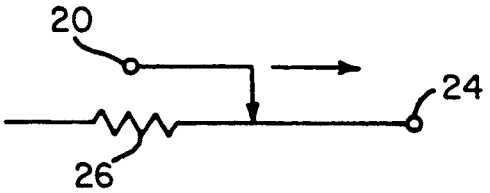

When it is desired to increase the current so as to provide full light or illumination intensity, the slide member 30 is moved further toward the right to the full "ON-position" as illustrated in FIGS. 4 and 7. In this position, the first conductive layer 18 is caused to move downwardly through the opening 28 defined within the intermediate layer 14 and into interengagement with the second conductive layer 22. As a result, there will be provided a higher current flow since the resistive component 26 will no longer be disposed within the current flow path comprising the electrical connection defined between the first and second switch terminals 20 and 24.

From the foregoing detailed description, it can thus be seen that the present invention provides an improved membrane switch which includes a series resistor so as to provide an initially reduced amount of current flow. The membrane switch of the present invention is relatively simple in its construction and is easy to manufacture and assemble.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the irvention will include all embodiments falling within the scope of the appended claims.

What is claimed is:

1. A membrane switch, comprising;

an upper layer of electrically insulating material having a first electrically conductive layer formed upon its lower surface, said first electrically conductive layer terminating at one end thereof with a first switch terminal;

a lower layer of electrically insulating material having a second electrically conductive layer formed upon its upper surface, said second electrically conductive layer terminating at one end thereof with a second switch terminal;

said second electrically conductive layer having a resistive component formed upon a second end portion thereof disposed opposite said second switch terminal; and an intermediate layer of electrically insulating material being disposed between said upper layer of electrically insulating material and said lower layer of electrically insulating material, said intermediate layer of electrically insulating material having an opening formed therein so as to enable said first electrically conductive layer disposed upon said upper layer of electrically insulating material to be movable thereinto so as to initially engage said resistive component when said upper layer of electrically insulating material is moved downwardly by an actuating means so as to produce an electrical connection comprising a relatively high resistance/low current state between said first and second switch terminals and through said first electrically conductive layer, said resistive component, and said second electrically conductive layer;

said actuating means being moved slidably relative to said first and second electrically conductive layers disposed upon said upper and lowr layers of electrically insulating material so as to cause subsequent engagement of said first electrically conductive layer disposed upon said upper layer of electrically insulating material directly with said second electrically conductive layer disposed upon said lower layer of electrically insulating material so as to produce an electrical connection comprising a relatively low resistance/high current state between said first and second switch terminals and through said first electrically conductive layer and said second electrically conductive layer.

2. A membrane switch as claimed in claim 1, wherein said first electrically conductive layer is screen-printed upon said upper layer of electrically insulating material in a particle-laden polymeric ink.

3. A membrane switch as claimed in claim 1, wherein said first electrically conductive layer is screen-printed upon said upper layer of electrically insulating material in a silver particle-laden polymeric ink.

4. A membrane switch as claimed in claim 1, wherein said second electrically conductive layer is screen-printed upon said lower layer of electrically insulating material in a particle-laden polymeric ink.

5. A membrane switch as claimed in claim 1, wherein said second electrically conductive layer is screen-printed upon said lower layer of electrically insulating material in a silver particle-laden polymeric ink.

6. A membrane switch as claimed in claim 1, wherein said resistive component is screen-printed upon said second electrically conductive layer in a carbon particle-laden polymeric ink.

7. A membrane switch as claimed in claim 1, wherein said actuating means includes a slide member and a spring connected to said slide member and having a finger for engagement with said upper layer of electrically insulating material.

8. A membrane switch, comprising:

an upper layer of electrically insulating material having a first electrically conductive layer formed upon its lower surface, said first electrically conductive layer terminating at one end thereof with a first switch terminal;

a lower layer of electrically insulating material having a second electrically conductive layer formed upon its upper surface, said second electrically conductive layer terminating at one end thereof with a second switch terminal;

said second electrically conductive layer having a resistive component disposed upon a second end portion thereof disposed opposite said second switch terminal;

an actuating member disposed atop said upper layer of electrically insulating material for causing electrical connection and disconnection between said first and second electrically conductive layers; and an intermediate layer of electrically insulating material being disposed between said upper layer of electrically insulating material and said lower layer of electrically insulating material, said intermediate layer of electrically insulating material having an opening formed therein so as to enable said first electrically conductive layer disposed upon said upper layer of electrically insulating material to be movable thereinto so as to initially engage said resistive component when said upper layer of electrically insulating material is moved downwardly by said actuating member so as to produce an electrical connection comprising a relatively high resistance/low current state between said first and second switch terminals and through said first electrically conductive layer, said resistive component, and said second electrically conductive layer;

said actuating member being moved slidably relative to said first and second electrically conductive layers disposed upon said upper and lower layers of electrically insulating material so as to cause subsequent engagement of said first electrically conductive layer disposed upon said upper layer of electrically insulating material directly with said second electrically conductive layer disposed upon said lower layer of electrically insulating material so as to produce an electrical connection comprising a relatively low resistance/high current state between said first and second switch terminals and through said first electrically conductive layer and said second electrically conductive layer.

9. A membrane switch as claimed in claim 8, wherein said first electrically conductive layer is screen-printed upon said upper layer of electrically insulating material in a particle-laden polymeric ink.

10. A membrane switch as claimed in claim 8, wherein said first electrically conductive layer is screen-printed upon said upper layer of electrically insulating material in a silver particle-laden polymeric ink.

11. A membrane switch as claimed in claim 8, wherein said second electrically conductive layer is screen printed upon said lower layer of electrically insulating material in a particle-laden polymeric ink.

12. A membrane switch as claimed in claim 8, wherein said second electrically conductive layer is screen printed upon said lower layer of electrically insulating material in a silver particle-laden polymeric ink.

13. A membrane switch as claimed in claim 8, wherein said resistive component is screen-printed upon said second electrically conductive layer in a carbon particle-laden polymeric ink.

14. A membrane switch as claimed in claim 8, wherein said actuating member includes a slide member and a spring connected to said slide member and having a finger for engagement with said upper layer of electrically insulating material.

15. A membrane switch, comprising:

an upper layer of electrically insulating material having a first electrically conductive layer formed upon a lower surface portion thereof, said first electrically conductive layer terminating at one end theerof with a first switch terminal;

a lower layer of electrically insulating material having a second electrically conductive layer formed upon an upper surface portion thereof such that said second electrically conductive layer is normally spaced and electrically isolated from said first electrically conductive layer, said second electrically conductive layer having a second switch terminal operatively connected thereto;

a resistive component disposed upon a first end portion of said second electrically conductive layer; and actuating means slidably movable relative to said first and second electrically conductive layers disposed upon said upper and lower layers of electrically insulating material between a first position, corresponding to said first end portion of said second electrically conductive layer, at which said first electrically conductive layer disposed upon said upper layer of electrically insulating material is caused to engage said resistive component so as to produce an electrical connection comprising a relatively high resistance/low current state between said first and second switch terminals and through said first electrically conductive layer, said resistive component, and said second electrically conductive layer, and a second position, corresponding to a second end portion of said second electrically conductive layer, at which said first electrically conductive layer disposed upon said upper layer of electrically insulating material is caused to directly engage said second electrically conductive layer disposed upon said lower layer of electrically insulating material so as to produce an electrical connection comprising a relative low resistance/-high current state between said first and second switch terminals and through said first electrically conductive layer and said second electrically conductive layer.

16. A membrane switch as set forth in claim 15, wherein:

said first and second electrically conductive layers are screen printed upon said upper and lower layers of electrically insulating materials, respectively, in a silver particle-laden polymeric ink.

17. A membrane switch as set forth in claim 15, wherein:

said resistive component is screen-printed upon said second electrically conductive layer in a carbon particle-laden polymeric ink.

18. A membrane switch as set forth in claim 15, wherein:

said actuating means comprises a slide member, and a spring-biased finger for engaging said upper layer of electrically insulating material.

* * * * *